US005349915A

United States Patent [19]

Thomas et al.

[11] Patent Number: 5,349,915

[45] Date of Patent: Sep. 27, 1994

[54] SUBMERSIBLE TRIM SYSTEM

[75] Inventors: David L. Thomas, Columbus, Ohio; Ronald L. Legue, Oxnard, Calif.

[73] Assignee: Battelle Memorial Institute, Columbus, Ohio

[21] Appl. No.: 75,684

[22] Filed: Jun. 11, 1993

[51] Int. Cl.[5] ..... B63B 39/02

[52] U.S. Cl. ..... 114/124; 244/93; 114/330

[58] Field of Search ..... 114/312, 317, 330, 331, 114/121, 124; 244/93

[56] References Cited

U.S. PATENT DOCUMENTS

| | | | |
|---|---|---|---|
| 2,857,122 | 10/1958 | Maguire | 244/93 |
| 2,916,232 | 12/1959 | Schramm | 244/93 |
| 3,362,367 | 1/1968 | Rosfelder | 114/124 |
| 4,014,280 | 3/1977 | Laxo | 114/124 |

OTHER PUBLICATIONS

"List System Handout", HO. 1.3.5.1; Deep Submergence School. Submarine Development Group One, Fleet Station Post Office, San Diego Calif. 92132.

"Trim System Handout", HO. 1.3.6.1; Deep Submergence School, Submarine Development Group One, Gleet Station Post Office, San Diego Calif. 92132.

*Primary Examiner*—Jesus D. Sotelo

*Attorney, Agent, or Firm*—Barry S. Bissell

[57] ABSTRACT

A trim system for a submersible comprises a ball control system and a hydraulic control system. The ball control system includes a tubular ball transfer line 33 substantially through the length of the vessel, a plurality of high-density, solid balls 34 within the ball transfer line 33 which are moveable to alter the weight distribution, a coil 1 at each end of the ball transfer line 33 as a reservoir for the balls 34, brake device 3 for temporarily fixing the position of the balls and sensing device 5 for determining the location of the balls. The hydraulic control system includes vehicle control unit 27, power transfer unit 13, manifold 2, compensator 20 and various valves, filters 17 and quick disconnects 12 for moving preselected balls through the ball transfer line 33.

16 Claims, 3 Drawing Sheets

SUBMERSIBLE TRIM SYSTEM

FIELD OF THE INVENTION

Control of the trim of a deep submergence vessel or submersible is basic to the operation of such vehicles. Current trim systems utilize mercury and oil. The mercury is pumped between distant chambers to redistribute it (and the oil complement) in a selected manner to provide the desired trim for the vessel. Because of its high specific gravity and liquid temperature range of between about −39° C. and 357° C., mercury has been an ideal component of such a trim system.

But mercury is reactive with many metals (particularly aluminum), forming a solution or an amalgam which can weaken equipment and structure if there is exposure during a spill. Mercury is also a toxic material, will vaporize to some degree even at room temperature and is extremely hazardous if released into the environment. This makes trim systems employing mercury dangerous to build, use and repair. State and federal regulations cover requirements for the inventory of mercury and for the cleanup of spills. The primary hazard areas associated with these mercury-based trim systems is usually aboard a mother ship and/or shore facility where maintenance is performed. A spill in a harbor or coastal waters would pose a special problem associated with a threat to the food chain.

SUMMARY OF THE INVENTION

It is an object of the invention to provide a trim system which is significantly safer to install, operate, and maintain than the current mercury-based systems, and whose constituent elements are environmentally benign.

It is also an object of the invention to provide a system in which the weight will not shift due to hydraulic fluid leakage, which is possible with a mercury system.

It is an object of the invention to provide a trim capability which is adjustable by utilizing both low and high-density weights to trade off an increase in the lift capability at the expense of the trim capability in certain situations.

In accordance with the objectives, the invention is a trim system for a submersible comprising the movement, by mechanical means or otherwise, of solid weights along a path to alter the weight distribution and to effect the change in either pitch or list of the submersible.

In a preferred embodiment, the trim system comprises a ball transfer conduit extending through the vessel, a string of high-density, solid spherical balls within the conduit and moveable therein and means for hydraulically moving the high-density, spherical balls through the conduit. The submersible trim system also typically includes a reservoir for the high-density, spherical balls at each end of the ball transfer conduit. A layered coil of conduit is a useful reservoir. The system may additionally include brakes for temporarily fixing the position of the high-density, spherical balls and position sensors for determining the location of the high-density, spherical balls.

Typically, the ball transfer conduit is between about 7 and 50 mm inside diameter and the high-density, spherical balls are between about 0.2 to 2 mm smaller in diameter than the ball transfer conduit. The balls are preferably made of tungsten or of a compound, mixture, alloy or sintered composite of tungsten.

In a particularly advantageous alternative of the invention, the submersible trim system further includes a plurality of low-density, substantially spherical balls within each reservoir and the ball transfer conduit at each end of the string of the high-density, substantially spherical balls. This allows a lowering of overall weight while still allowing efficient trim system operation as the low-density balls are used as spacers to move and hold the high-density balls in the important weight shift region of the ball transfer conduit.

DESCRIPTION OF THE PREFERRED EMBODIMENTS

The invention is useful in adjusting the pitch (the fore and aft tilt) of a submersible (the control of which is conventionally referred to as the trim) or the list, heel or roll (the side to side tilt). We will refer to the invention as a trim system, but we intend to generically refer to both pitch and list systems.

The invention is also particularly useful as a trim system for deep submergence vessels (DSV), remotely operated vehicles (ROV), autonomous underwater vehicles (AUV) and other manned and unmanned vessels. These unmanned vessels may not have a pressure hull and the manned vessels generally have only small pressure hulls with limited room for trim systems. The present invention may therefore be located outside the pressure hull but within an unpressurized outside shell. The invention could also be used in larger, shallow-water submergence vessels such as manned submarines, but there are other systems which may be more desirable under those conditions. We intend to include all of the above vessels within the terms submersible, vessel or submergence vessel.

The invention generally comprises the movement, by mechanical means or otherwise, of solid weights along a path to alter the weight distribution and to effect the change in pitch or list of the submersible. The Figures and description refer generally to a preferred embodiment of the invention comprising the use of spherical balls, round conduit and a hydraulic system to move the balls. The preferred embodiment represents a practical solution, because spherical balls can be readily fabricated and moved through conventional round tubing.

Figure 1A:
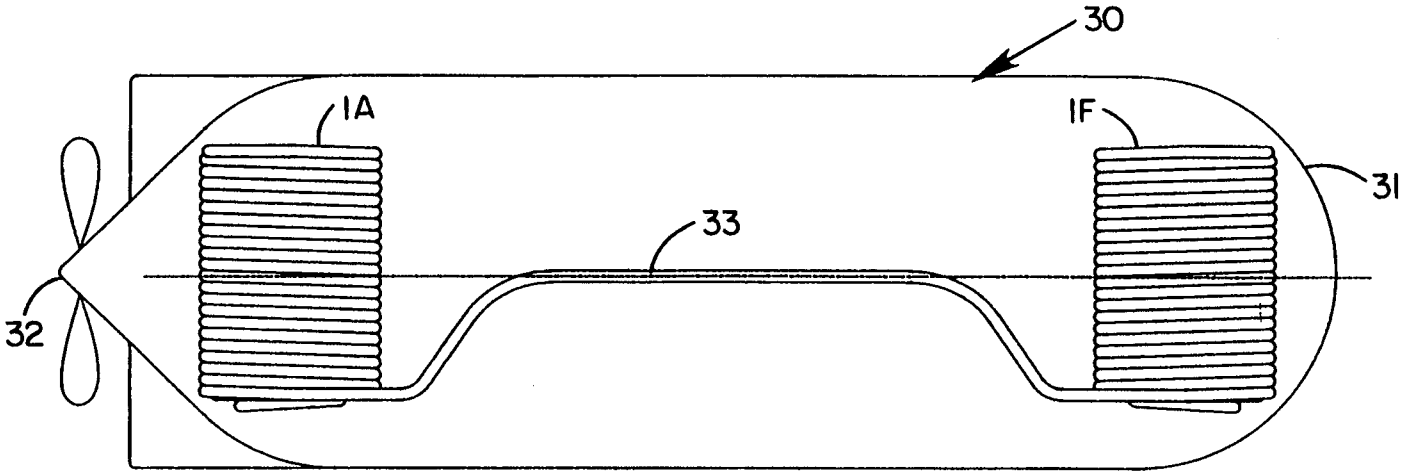
FIG. 1A and FIG. 1B are, respectively, the plan and elevation schematic views of a submersible and apparatus for controlling the trim of such vessel.
Figure 1B:
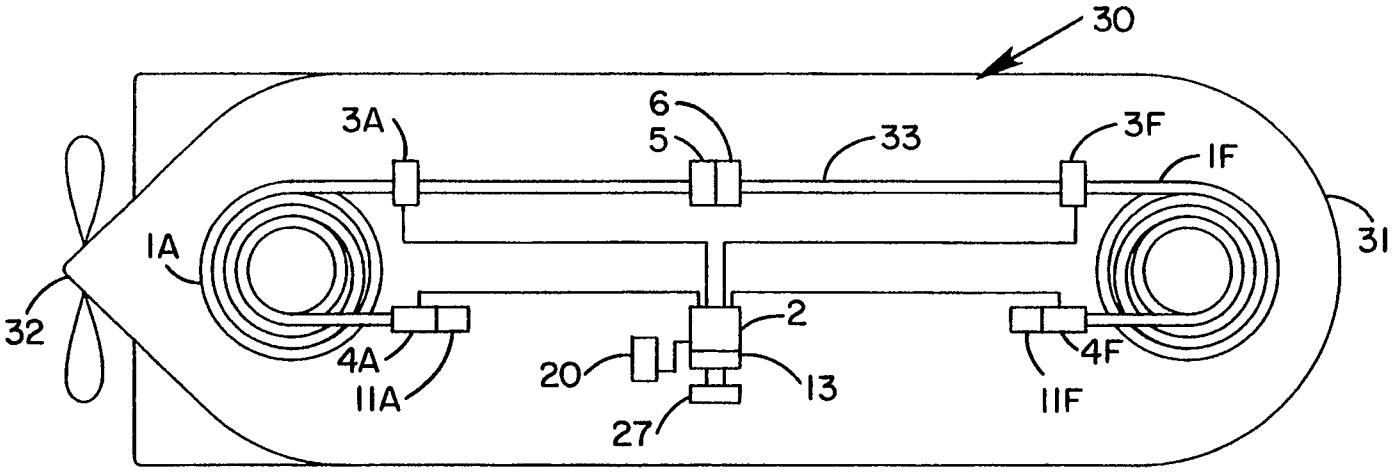

Basic elements of a preferred embodiment of the invention can be seen in the schematic drawing in FIG. 1A and FIG. 1B. Very simplistically, the Figures show a submersible 30 having a forward end 31 and an aft end 32. A trim system according to the invention for controlling the pitch of the vessel is shown comprising a ball transfer line or conduit 33, aft coil 1A, forward coil 1F. High-density balls are contained in the coils and the conduit along with a hydraulic fluid. A loading port 6 in the ball transfer conduit 33 is used to load/unload balls and for maintenance or any other purpose.

Bumpers 4A and 4F at the end of each coil decelerate the balls over an extended distance to prevent damage to the balls or the coil by uncontrolled impact. For safety, deep submergence vehicles usually have several major subsystems that can be jettisoned in an emergency to shed weight so as to increase buoyancy. Jettison ports 11A and 11F are shown near the bumpers to be used in the case they are needed.

Also shown in FIG. 1B are several components for hydraulic power and control of the ball trim system (to be later described in detail) comprising vehicle control unit 27, power transfer unit 13, manifold 2. Compensator 20 and associated valves provide the necessary fluid control for maintaining the lowest pressure in the chambers of the trim hydraulic system at slightly above ambient sea water pressure. Position sensor 5 detects motion of the balls in the transfer line. Brakes 3A and 3F between each coil and the ball transfer line mechanically lock the balls in place following transfer, so the balls cannot shift (even due to leakage of hydraulic fluid).

The trim system is designed to take advantage of two components of hydraulic flow to move and lift the balls at fairly low system pressures. In particular, the balls are made to be slightly smaller in diameter than the conduit so that an annular orifice is formed between the ball and the conduit wall. This annular orifice allows fluid under pressure to slip past each ball. The gross flow of the fluid moves the balls in the same way as it would if the balls were tightly positioned within the conduit (that is with the direct force on the first ball). The slip flow through the annular orifice additionally results in a differential pressure across the ball which causes a motive force on the ball parallel to the conduit.

Figure 2A:
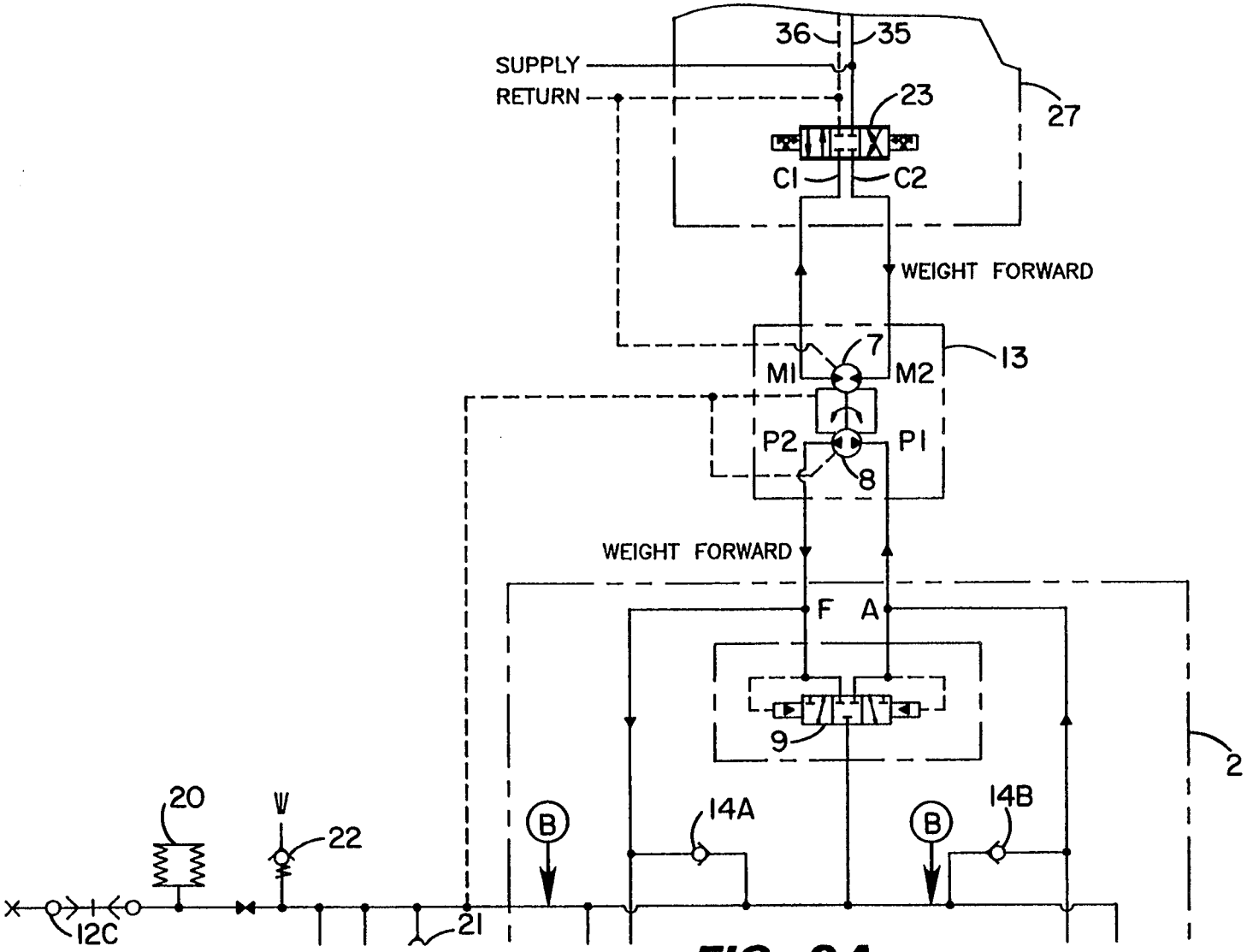
FIGS. 2A, 2B show schematic of the trim system along with hydraulic means for operating the trim system.
Figure 2B:
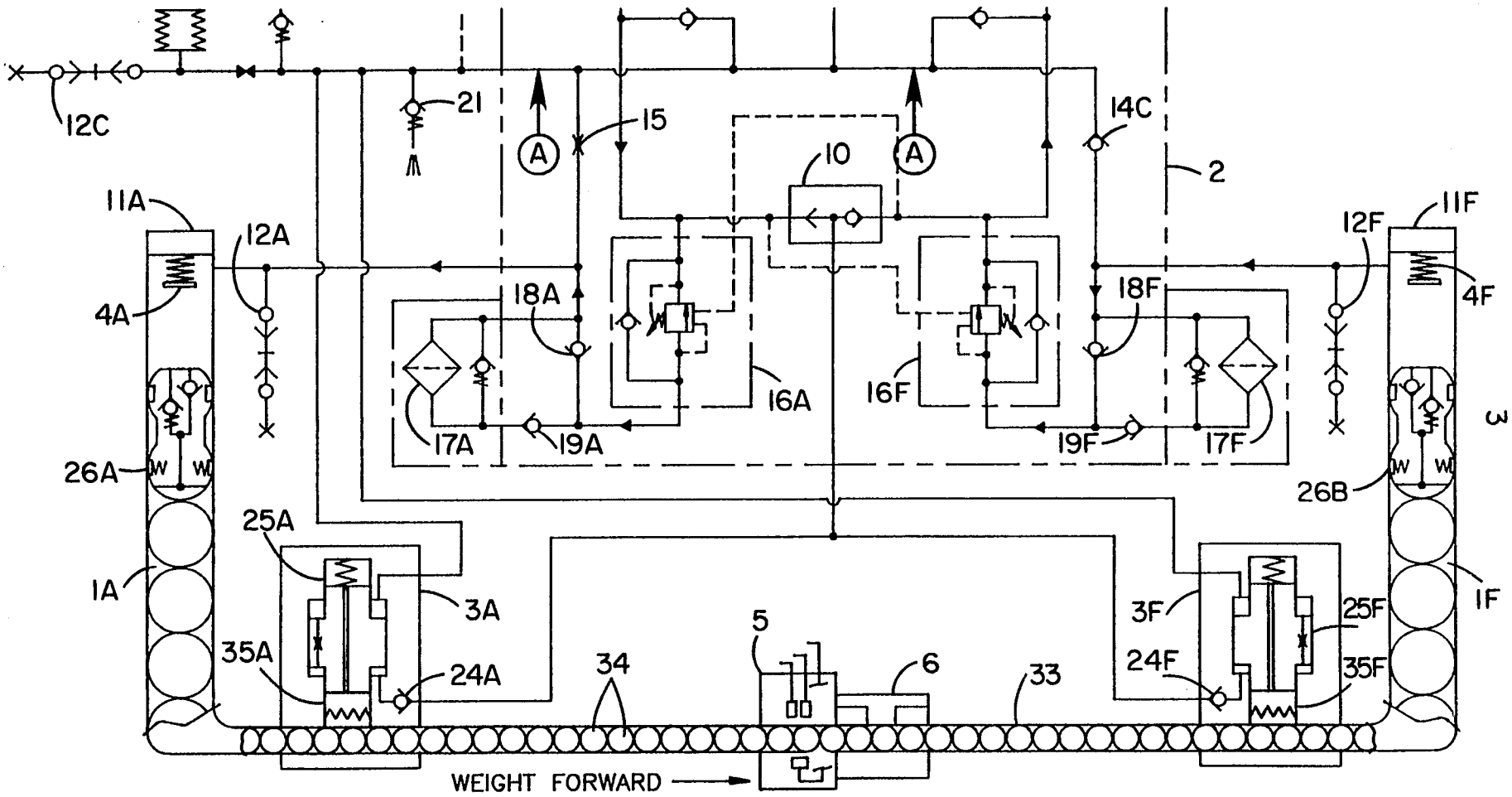

Looking now at FIGS. 2A, 2B the trim system including the ball transfer subsystem and the hydraulic subsystem is shown in greater detail.

The Ball Transfer Subsystem

In the ball transfer subsystem, the ball transfer line 33 and the end coils 1A and 1F contain the heavy balls 34 in contact with each other. The end coils 1A and 1F are shown in FIG. 2B for simplicity as upright members, however, they are preferably formed as shown in FIG. 1B comprising helically wound conduit having several layers or wraps. This, of course, allows a much greater storage volume for balls at each coil. The balls and conduit are also shown as two different sizes in FIG. 2B, but this is again for clarity, and the coils and ball transfer line would normally be of essentially the same diameter (an exception is described later).

Brakes 3A and 3F are shown between each coil 1 and the ball transfer line 33. The purpose of the brake is to hold the balls in place and prevent motion once weight transfer has ceased. The brake may be made in any known fashion to hold the balls when ball transfer is completed, for example, the brake may have a spring-loaded pressure-released plungers 35A and 35F that squeeze and hold the balls. The ball contact area of the plunger could be grooved so that the spring-developed clamping force can be less than that required for a parallel-cylindrical surfaces configuration. The plunger may have an annular piston actuated by hydraulic pressure to release the brake. And, there may also be a passage through the plunger, so that as the plunger moves, there is no flow required in the ball system. There is a check valve 24 and a restrictor valve 25 so that the plunger will move slowly into engagement with the balls and will not engage moving balls.

The bumpers 4A and 4F are attached at the end of each coil to decelerate the balls over a significant distance and thereby prevent damage to the balls or the coil. If the balls are stopped abruptly by a rigid shoulder, an event similar to water hammer would occur. This could cause significant loads, although not nearly as severe as can occur due to an abrupt stop in a mercury system, because the balls are not all perfectly aligned, do create individual frictional drag forces on the tubing, and are not necessarily all in contact.

There is a loading port 6 in the transfer line 33 located in a position convenient for maintenance and loading or unloading balls. The sensor 5 is located in the ball transfer line preferably near the midpoint if there is only one sensor. Several sensors could, of course, be used at various locations. The sensor (or sensors if needed) along with the necessary electronics signal processing and display equipment (conventional equipment, not shown) makes it possible to monitor ball position and therefore to observe the movement of balls as a change in trim is executed. Mechanical, magnetic, or magnetic induction sensors may be used.

Weight jettison could be accomplished in several possible ways. One approach is shown in FIGS. 1B and 2B with two jettison ports, 11A and 11F to the outside of the vessel. To accomplish jettison, one of the two jettison ports would be released by hydraulic or pyrotechnic means and then the trim system would be powered in the normal manner to move the weight through the jettisoned port and thence overboard. To ensure reliable weight jettison, either the hydraulic fluid compensator 20 would be designed to have adequate capacity for this operation or the hydraulic pump 8 would be qualified for brief pumping of sea water. Other jettison approaches are (1) mechanically releasing both coils, or (2) providing a single jettison port somewhere on the transfer line and using the hydraulic pump (which would be required to operate in both directions to clear out all weight).

The ball transfer subsystem further comprises two ball pistons 26A and 26F, one at each end of the string of balls. The purpose of the ball pistons is to exert a force toward the string of balls during movement, thereby keeping the balls from separating. Small gaps may be tolerable, but gaps large enough to be a significant fraction of the length of the ball transfer line, might cause troublesome weight shifts. The ball pistons may travel the full length of, but do not leave, the coil in which installed.

When moving the balls, the downstream ball piston must oppose the movement of the string of balls. This is accomplished with springloaded shoes which (when actuated outward against the conduit wall) create frictional drag to hold back the piston and exert a force against the movement of the balls. Seals at the other end of the piston minimize leakage. There is a check valve to allow essentially free slip flow of hydraulic fluid through the piston to minimize the differential pressure that would create a force in opposition to the frictional drag force of the shoes. The upstream piston must encourage the movement of the string of balls. It has a relief valve (shown as a check valve with a spring) that provides sufficient differential pressure due to slip flow to overcome any spring-loaded-shoe frictional drag force and to provide additional push on the end ball of the moving string.

The Hydraulic Subsystem

The trim hydraulic subsystem comprises vehicle control unit 27, power transfer unit 13, manifold 2, compensator 20 and various valves, filters 17 and quick disconnects 12. The hydraulic subsystem works together with the hydraulic components of the ball transfer subsystem (such as the ball pistons) to provide the desired movement of balls in the trim system.

The vehicle control unit 27 comprises servo-valve 23, hydraulic fluid supply line 35 and return line 36. The unit may also contain various valves to control other vehicle functions. Hydraulic power is supplied to the servo-valve by the conventional vehicle hydraulic system (not shown) generally comprising a pressure compensated hydraulic pump driven by a battery-powered electric motor. The speed, acceleration, and direction of ball movement is controlled by the servo-valve 23, which is operated automatically by computer command inputs or manually with an override circuit. The direction of the primary hydraulic fluid flow to move weight forward is shown by the solid arrowheads on the flow lines. The direction of the primary flow to move weight aft is indicated by reversing the flow indicated by the solid arrowheads. A servo-valve is used to provide precise control of flow to avoid excessive pressure transients that could cause lines or valves to rupture.

The power transfer unit 13 isolates the trim hydraulic system from the vehicle hydraulic system and converts the pressure-flow capability of the vehicle system to that required for the trim system. The isolation of one system from the other may not in fact be required, but would prevent contamination of the vehicle system which might enter through the trim system.

The pressure and flow of the trim system are derived from the system performance requirements, including the trim moment and speed of transfer and the maximum height the weight must be raised. The requirements will vary considerably from system to system, but in general, the pressure required for the trim system will be lower (perhaps hundreds of psi) than that available in the vehicle hydraulic system (likely to be thousands of psi).

The power transfer unit consists of a hydraulic pump 8 driven by a hydraulic motor 7. The displacement (cubic inches per revolution) of each unit can be selected to provide maximum efficiency, a reasonable maximum rotational speed, and the decreased pressure needed. Thus the pump will be of greater displacement than the motor, so pump output will have greater flow at lower pressure. The trim system hydraulic pump 8 could also be directly driven by an electric motor. However as with hydraulic servo valve speed control, motor speed control would be desirable to minimize the magnitude of hydraulic pressure transients during starting, stopping, and reaching the end of travel when the weight is fully shifted in one direction.

A compensation system including compensator 20 maintains the pressure in the trim system at slightly above the ambient sea-water pressure (to prevent the leakage of sea water into the system) and has sufficient volume to make up the trim system hydraulic fluid volume that is lost to fluid compression as the depth of the vehicle increases.

Manifold 2 contains conventional hydraulic valve components 9, 10, 14, 15, 16, 18, 19 selected for this application. The manifold is a convenient way to minimize valve connections (which otherwise may cause leaks and decrease reliability) and to protect the valves from the salt water. The holding, over-center, motor control, or counterbalance valves 16A and 16F control the motion of the balls and prevent a runaway condition when lowering the load of balls. The holding valve 16 consists of a check valve and a relief valve with both direct and pilot-assisted action. The check valve allows free flow to the load. The relief valve controls flow away from the load. The relief valve is set with a relief pressure greater than the maximum possible load-generated static pressure. If the system was horizontal, there would be no load-generated pressure. If there was no pilot-assisted action, full pressure would be required to "push" the load down. The pilot action reduces the pressure required for lowering the load to a small fraction of the full pressure. The effect of the holding-valve action is to lower the load smoothly at the velocity determined by flow from the hydraulic pump.

The check valves 18 and 19 cause flow to the coil to go around the filter 17 and cause the flow from the coil to go through the filter. The objective is to minimize the quantity of contamination generated by the balls that can reach the control valves and more importantly, the pump 8. The filter 17 has a bypass relief valve so that operation can proceed even if the filter element clogs.

The shuttle valve 10 directs flow from the high-pressure side of the circuit to release the brakes 3 when pressure is applied to move the balls. The brakes are reset when the pressure is released from this line.

The shuttle valve 9 connects the compensator 20 to the low-pressure side of the pump 8 so that regardless of the direction of pump rotation the compensator is always connected to the pump inlet port. Check valves 14 connect the compensator 20 to several areas of the circuit in the manifold 2 so that any voids are filled with fluid during descent. Restrictor valve 15 allows some compensation flow during descent, but more importantly causes pressure bleed off in trapped volumes during ascent to prevent excessive differential pressure that could cause damage.

Relief valve 21 limits the positive pressure in the compensation system. This valve will open if the system is charged through the quick disconnect coupling 12C and the pressure reaches the cracking pressure. This valve will also open if the compensation pressure increases due to heating of the system. Heating can occur during hydraulic check out, when the vessel rises from a deep dive or when the vessel is taken out of the water (and placed in the sun on the deck of the mother ship, for example). Relief valve 22 will open to admit sea water if the hydraulic fluid volume capacity of the compensator 20 is exceeded and the pressure in the hydraulic system drops below the ambient sea water pressure. Its purpose is to prevent damage due to implosion.

Quick disconnects 12A and 12F provide convenient means for attaching to the system for maintenance and loading or unloading balls. Quick disconnect 12C provides a means to fill or drain the compensator 20 which maintains the low-pressure chambers in the hydraulic system at slightly above ambient sea water pressure.

Operational Example

Operation of the trim system shown in FIG. 2A, 2B is summarized in the following hydraulic fluid flow description. If the servo-valve 23 is shifted (in response to automatic or manual actuation) in a direction to move weight forward, flow will be as indicated by the solid arrowheads. Flow from C2 to M2 on the motor will cause flow from P2 on the pump to Port F on the manifold. This will cause pressure to shift the shuttle valve 9 to the right and connect the compensator 20 to the pump inlet through manifold Port A. Flow will occur from the shuttle valve 10 through the check valve 24A to brake 3A and through the check valve 24F to brake 3F, thereby releasing both brakes.

Pilot pressure will be applied to the holding valve 16F which will assist opening of the relief valve. Flow will pass through the check valve in the holding valve 16A, through the check valve 18A, the bumper 4A, the aft coil 1A, the relief valve of ball piston 26A (slip flow only), and the check valve of ball piston 26F (slip flow only) which will cause the balls to move forward. Flow from the forward coil 1F. will pass through the bumper 4F, the filter 17F, the check valve 19F, the holding valve 16F (check valve) to the pump (inlet) port P 1 through manifold Port A.

Design Features

The coils, ball transfer line and other components are made from conventional strong, corrosion-resistant materials such as stainless steel. To minimize the space required for the coils, a multiple-layer configuration such as is shown in FIG. 1A is preferred. The inside diameter of the tubing must be controlled and finished so as to be compatible with the passage of balls and with the ball piston. Connections between the coils, ball transfer line, brakes, bumpers, sensor, and loading port must be such that the tubing inside diameter is not changed and the balls can pass through freely.

On the one hand, the spherical balls are advantageously made of any heavy material to effect the desired weight transfer in the most efficient way; the preferred materials being metals, metal alloys, and metal composites. Materials which are relatively inexpensive and non-reactive are especially preferred. Tungsten and its alloys are a good ball material because tungsten has a high specific gravity (approximately 18.0 in a usable form), it has reasonably good strength, it is safe to handle, it is corrosion resistant in salt water, and it is relatively inexpensive compared with other solids of similar density (e.g., gold and platinum).

On the other hand, given the undersea application, the balls, coils and transfer line might advantageously be designed to minimize the overall system weight and the power required for actuating the balls. These apparently conflicting goals and the desire to provide the capability to adjust the maximum trim moment may be accomplished with an alternative embodiment of the invention. A combination of light and heavy balls may be used to optimize the trim efficiency and overall system weight. The light balls are installed on each end of the string of heavy balls. When the weight is all transferred forward for instance, all of the heavy balls are in the forward coil and the light balls are in the transfer line between the brakes on the coils. If light balls were not used, the transfer line would be filled with heavy balls which would cause greater system weight without any increase in the trim weight moment developed by the system. If the transfer line is not completely filled with balls, the balls that are there could shift and cause a change in the trim moment, which could be undesirable.

The light balls also provide a convenient means for decreasing the trim capability and increasing the lift capability of a submersible for a specific mission. The maximum trim moment capability can be decreased by substituting light balls for heavy balls. Ideally, a sufficient quantity of light balls would be added to each coil to replace the heavy balls removed. If the heavy balls are removed without substituting light balls, there would be large gaps between the balls and the ball pistons would not be as effective.

Candidate materials for the light balls are plastics having a low specific gravity (e.g. less than about 2), including acetal, polysulfone, and polyamide-imide. These materials are low density, high strength, and compatible with hydraulic fluid and sea water.

The system must be designed to shift weight when the vehicle is inclined at some maximum angle. The diameters of the light and heavy balls and the inside diameter of the coils and transfer lines can be selected to minimize the pressure required to shift weight upward when there is a maximum height difference between the two coils. The coils and transfer line may be fabricated so as to minimize the variation in the inside diameter of the tubing due to forming and to rough handling. There must be adequate clearance between the diameter of the balls and the inside diameter of the conduit to accommodate manufacturing variations in both. However, the greater the clearance, the greater will be the slip flow necessary to support and move the weight of the balls in the transfer line when it is at maximum inclination.

The size of balls and conduit depend on many factors including the weight of the balls to be moved, the speed of movement, the space available for the ball reservoirs, the bending characteristics of conduit for forming a coil, the length of the tubing available in a continuous piece, the available sizes of tubing diameter and wall thickness, and practical manufacturing variations (tolerances) in conduit and balls. If the balls are too small, the velocity can exceed practical limits for hydraulic flow. If the balls and conduit are too large, the practical limits for bending conduit to form the coil small enough to fit in the available space may be exceeded.

When applying the conditions stated above, it is important that the ball diameter be slightly less than the inside diameter of the conduit so that the above described slip flow can occur in the annular orifice between the ball and the conduit. This results in the differential pressure across each ball which provides the motive force on each ball. Tubular conduit (and coils) with an inside diameter within the range of about 7–50 mm is preferred using balls with a diameter of about 0.2 to 2 mm smaller than the inside diameter of the conduit.

In another embodiment, the maximum system pressure may be reduced by making the inside diameter of the ball transfer line smaller than the inside diameter of the coil conduit and/or by making the light balls smaller in diameter than the heavy balls. The predominant pressure requirement for the trim system is to lift the balls in the ball transfer conduit when there is the greatest elevation difference between the two coils. Little pressure is required to lift the balls in the coils themselves, because there is little elevation change and the ball forces are essentially balanced. Essentially only the frictional forces must be overcome. To minimize the maximum required system pressure, the inside diameter of the ball transfer line can be smaller than the inside diameter of the coil conduit and the diameters of the heavy and light balls can be selected so that the weight of each will be supported by the same slip flow in the ball transfer line. This refinement has the potential for reducing the overall pressure requirement by a factor of about 2–6, depending on the system requirements and also for significantly decreasing the transfer time.

The greatest system pressure is required for the situation in which the vehicle is pitched so that the coils are positioned with the greatest elevation difference and all of the heavy balls are in the lower coil. If both the coil and ball transfer conduits are of the same inside diameter and the light and heavy balls are of the same spherical diameter, slip flow will cause the same differential pressure across each ball. So the pressure to lift the heavy balls in the transfer line must be exerted on each ball in the system. Since the length of conduit in each coil is likely to be much greater than the length of the ball transfer line (3 to 10 times perhaps), the maximum system pressure that is required for lifting the balls can be reduced substantially by increasing the clearance between the balls and the coil conduit inside diameter. Also, selecting the heavy and light ball diameters so that the same slip flow will support both balls minimizes the tendency for opening up a gap between the strings of light and heavy balls especially when the balls are being lifted in the transfer line.

The balls may be moved by a variety of means, however, hydraulic power is preferred. Other means include mechanical, electromagnetic and pneumatic. With hydraulic ball actuation the balls are immersed in hydraulic fluid, so they are lubricated to minimize wear, and they are protected from corrosion and marine growth. The hydraulic fluid can be powered and controlled by conventional pumps and valves and may be the same hydraulic fluid that is used for other hydraulic functions on a vehicle.

We claim:

1. A trim system for a submersible comprising

A. an elongated, ball transfer conduit communicating with the submersible and extending from a first position to a second position;

B. a plurality of unconnected high-density balls within the ball transfer conduit and moveable therein;

C. means for hydraulically moving preselected balls in the ball transfer conduit and altering the weight distribution of the submersible, wherein the high-density balls are spherical and the ball transfer conduit is circular in cross section and they cooperate to form an annular orifice therebetween sufficient to allow the slip flow of hydraulic fluid through the annular orifice.

2. The submersible trim system of claim 1 wherein the ball transfer conduit is between about 7 to 50 mm inside diameter and the high-density, spherical balls are between 0.2–2 mm in diameter smaller than the ball transfer conduit.

3. A trim system for a submersible comprising

A. an elongated, ball transfer conduit communicating with the submersible and extending from a first position to a second position;

B. a plurality of high-density balls within the ball transfer conduit and moveable therein;

C. a reservoir for the high-density, spherical balls at each end of the ball transfer conduit near the first and second position;

D. means for hydraulically moving preselected balls in the ball transfer conduit and altering the weight distribution of the submersible, wherein the high-density balls are spherical and the ball transfer conduit is circular in cross section and they cooperate to form an annular orifice therebetween sufficient to allow the flow of hydraulic fluid through the annular orifice.

4. The submersible trim system of claim 3 which further comprises a plurality of low-density, spherical balls within each reservoir and the ball transfer conduit at each end thereof and separated by the high-density, spherical balls, the low-density, spherical balls and high-density, spherical balls being in contact with each adjacent ball to form a string of spherical balls.

5. The submersible trim system of claim 4 which additionally includes a ball piston in each reservoir in contact with the string of spherical balls and comprising frictional drag means, a seal to minimize leakage, a check valve for free flow of hydraulic fluid, and a relief valve to create pressure so each ball piston applies a force against the string of balls to maintain contact between the spherical balls.

6. The submersible trim system of claim 4 wherein the diameter of the low-density, spherical balls is less than the diameter of the high-density, spherical balls.

7. The submersible trim system of claim 3 wherein the reservoir comprises a coil of conduit.

8. The submersible trim system of claim 7 wherein the coil conduit has an inside diameter greater than the diameter of the ball transfer conduit.

9. The submersible trim system of claim 7 which further comprises a plurality of low-density, spherical balls within each coil conduit and the ball transfer conduit at each end thereof and separated in the ball transfer conduit by the high-density, spherical balls.

10. The submersible trim system of claim 9 wherein the diameter of the low-density, spherical balls is less than the diameter of the high-density, spherical balls.

11. The submersible trim system of claim 7 which further comprises brake means in the ball transfer conduit for temporarily fixing the position of the high-density, spherical balls and the low-density, spherical balls therein.

12. The submersible trim system of claim 11 which further comprises a position sensor for mapping the position of any of the high-density, spherical balls, and means communicating with the position sensor for displaying the position of the high-density, spherical balls.

13. A method for altering the trim of a submersible comprising providing an elongated ball transfer conduit in communication with the submersible and extending from a first position to a second position and a string of high-density, spherical balls within the ball transfer conduit, each high-density, spherical ball and the ball transfer conduit cooperating to form an annular orifice therebetween;

changing the distribution of weight of the submersible by hydraulically moving preselected of the high-density, spherical balls in the ball transfer conduit by flowing hydraulic fluid through the annular orifices resulting in a pressure differential from one side of each high-density, spherical ball to the other side;

sensing the location of the high-density, spherical balls in response to the hydraulic movement, and temporarily fixing the position of the high-density, spherical balls when the desired trim is accomplished.

14. The method of claim 13 for altering the trim of a submersible which additionally includes providing a reservoir for the high-density, spherical balls at each end of the ball transfer conduit near the first and second positions.

15. The method of claim 14 for altering the trim of a submersible which further comprises providing a plurality of low-density, spherical balls within each reservoir and the ball transfer conduit at each end of the string of the high-density, spherical balls.

16. The method of claim 15 for altering the trim of a submersible further comprising providing the low-density, spherical balls with a diameter less than the diameter of the high-density, spherical balls.

* * * * *